US007695159B2

(12) United States Patent
Holloway

(10) Patent No.: US 7,695,159 B2
(45) Date of Patent: Apr. 13, 2010

(54) APPARATUS AND METHOD FOR ILLUMINATING ARTICLES OF JEWELRY

(76) Inventor: Garry Ian Holloway, 112-114 Cantebury Road, Cantebury, Victoria (AU) 3126

( * ) Notice: Subject to any disclaimer, the term of this patent is extended or adjusted under 35 U.S.C. 154(b) by 110 days.

(21) Appl. No.: 11/719,886

(22) PCT Filed: Nov. 25, 2005

(86) PCT No.: PCT/AU2005/001787

§ 371 (c)(1),
(2), (4) Date: Jun. 12, 2007

(87) PCT Pub. No.: WO2006/056019

PCT Pub. Date: Jun. 1, 2006

(65) Prior Publication Data

US 2008/0007941 A1 Jan. 10, 2008

(30) Foreign Application Priority Data

Nov. 26, 2004 (AU) ..... 2004906796

(51) Int. Cl.
*F21V 1/00* (2006.01)
*F21V 21/08* (2006.01)

(52) U.S. Cl. ..... 362/248; 362/227; 362/145; 362/104

(58) Field of Classification Search ..... 362/227, 362/235, 236, 240, 248, 145, 147, 103, 104, 362/290
See application file for complete search history.

(56) References Cited

U.S. PATENT DOCUMENTS

| | | | | |
|---|---|---|---|---|
| 2,625,646 | A * | 1/1953 | Goebel | 362/224 |
| 4,209,212 | A | 6/1980 | McGoldrick | |
| 4,945,460 | A * | 7/1990 | Von Kohorn | 362/290 |
| 6,210,022 | B1 * | 4/2001 | Howard | 362/235 |
| 6,302,557 | B1 | 10/2001 | Santosuosso et al. | |
| 6,886,962 | B2 * | 5/2005 | Suehiro | 362/241 |
| 6,953,265 | B2 * | 10/2005 | Suehiro et al. | 362/241 |
| 7,207,698 | B2 * | 4/2007 | Kotovsky et al. | 362/321 |
| 7,325,940 | B2 * | 2/2008 | Cea et al. | 362/155 |
| 7,572,028 | B2 * | 8/2009 | Mueller et al. | 362/227 |
| 2003/0193800 | A1 * | 10/2003 | Lai et al. | 362/240 |

FOREIGN PATENT DOCUMENTS

JP 11-318656 11/1999

OTHER PUBLICATIONS (*) = English language abstract only.

* cited by examiner

*Primary Examiner*—Jacob Y Choi
(74) *Attorney, Agent, or Firm*—Baker & Daniels LLP

(57) ABSTRACT

A lighting apparatus (600) for illuminating display items, and particularly articles of jewelry including gemstones such as diamonds, located within a display area. The apparatus (600) includes a plurality of substantially white light sources (604) arranged such that each light source (604) is spaced apart from adjacent light sources of the apparatus (600). Light absorbing material (608) is disposed so as to substantially occupy the spaces between adjacent sources (604) when viewed from within the display area. Accordingly, light is emitted into the display area as a plurality of bright regions interspersed with one or more regions of darkness. The lighting apparatus is particularly effective in producing desirable and visually perceptible effects, such as fire and scintillation, within a gemstone. Furthermore, the invention enables the desirable visually perceptible effects to be produced in a more pleasing fashion and/or with lower power consumption and heat generation than is the case with comparable prior art lighting arrangements. Methods of using the lighting apparatus for viewing items of jewelry are also provided.

15 Claims, 4 Drawing Sheets

APPARATUS AND METHOD FOR ILLUMINATING ARTICLES OF JEWELRY

CROSS-REFERENCE TO RELATED APPLICATION

This application is related to and claims the benefit under 35 U.S.C. §119 and 35 U.S.C. §365 of International Application No. PCT/AU2005/001787, filed Nov. 25, 2005.

FIELD OF THE INVENTION

The present invention relates generally to a method and apparatus for lighting, and in particular to a method and apparatus for use within a jewelry showroom or store for illuminating and viewing items of jewelry to enable visually perceptible features of gemstones, such as diamonds, to be observed.

BACKGROUND OF THE INVENTION

When displaying and showing items of jewelry that include gemstones, such as diamonds, it is desirable to provide a lighting environment that enables the visually perceptible features of the gemstones to be readily observed. For example, cut diamonds exhibit visually perceptible qualities generally referred to as "fire" and "scintillation", that strongly influence an observer's subjective evaluation of the aesthetics of a diamond. The term "fire" usually refers to the rainbow colours that may be observed in a diamond as a result of the refraction of light entering and leaving the facets of the diamond, and the dispersion of the light within the diamond. The term "scintillation" usually relates to the "sparkle" of a diamond, and refers to flashes of light that may be visible within a diamond when either the diamond or the observer's viewing position moves relative to a source of light.

In order to best highlight features of a gemstone such as fire and scintillation, it is undesirable to substantially flood the environment with light. Rather, it is generally considered that point sources of lighting are the most effective, since each point source produces distinct reflections and other optical effects within a gemstone producing visible results that are clearly discernable by an observer. Accordingly, in modern jewelry stores and showrooms the most popular light sources are halogen lamps, mounted in fittings having rear reflectors. Since halogen lamps are relatively small, they provide a good approximation to a point light source having a concentrated and reasonably intense light output. However, since the total light output from a single halogen lamp is relatively small, as compared with conventional incandescent globes or fluorescent lighting, it is necessary in a jewelry showroom or store to use a relatively large number of halogen lamps.

A typical halogen lamp used in a showroom or store environment dissipates 50 watts of power, and operates from a 12 volt source normally provided from a transformer connected to the mains power supply. A typical jewelry store using 50 halogen spot lamps therefore dissipates 2,500 watts in lighting alone, plus the additional power consumption resulting from transformer inefficiency and losses in the relatively higher current 12 volt leads supplying the lamps. Since a significant proportion of this power is dissipated as heat, the overall heating effect of the lighting within the showroom may approximate that of a domestic bar radiator. This may in turn increase the demands on air conditioning within the store.

The relatively recent development of bright white-light LEDs (Light Emitting Diodes) has provided a possible alternative to halogen spot lamps. For example, white-light LEDs have been used to make small desktop displays that may be used to view articles of jewelry. In using such a display, a customer may hold an item of jewelry, or in the case of a ring, may wear the jewelry on their hand. The customer then places their hand within the desktop display box, the interior of which is illuminated with white-light LEDs. Since the LED light sources are very small, they can result in the production of significant fire and scintillation effects.

However, white-light LEDs may not provide a sufficiently natural source of light. Most bright white-light LEDs consist of a blue LED with a phosphor coating applied to the glass or plastic lens and cover that protect the LED and direct the light output. The blue light from the LED is absorbed by the phosphor coating, which then emits light across the visible spectrum to produce a substantially white light output. However, the light output generally retains a strong blue component that is not balanced by the other colours of the spectrum emitted by the phosphor coating. The result is a cold and blue dominated light output that tends to produce an unnatural and subjectively unpleasant rendering of many colours, and in particular of skin tones. The customer viewing their hand along with the article of jewelry under such lighting is likely to be aware that an unnatural light source is being used, and may therefore suspect that the lighting has been designed to artificially enhance the appearance of the jewelry within the store or showroom in ways that will not be reproduced in more normal or natural lighting environments.

It is therefore an object of the present invention to provide an alternative apparatus and method for display lighting which is especially suited for illuminating items of jewelry, for example within a store or showroom environment, and which mitigates the aforementioned problems of known showroom lighting systems.

Any discussion of documents, devices, acts or knowledge in this specification is included to explain the context of the invention. It should not be taken as an admission that any of the material formed part of the prior art base or the common general knowledge in the relevant art on or before the priority date of the following statements of invention, or of any claims appended hereto.

SUMMARY OF THE INVENTION

In one aspect, the present invention provides a lighting apparatus for illuminating display items within a display area, the apparatus including a plurality of a substantially white light sources arranged such that each light source is spaced apart from adjacent light sources of the apparatus, characterised in that the apparatus further includes light absorbing material disposed so as to substantially occupy the spaces between adjacent sources when viewed from within the display area, whereby light is emitted into the display area as a plurality of bright regions interspersed within one or more regions of darkness.

Accordingly, when an article of jewelry including a gemstone, such as a diamond, is positioned within the display area illuminated by the apparatus, multiple distinct reflections of the light emitted from the bright regions of the apparatus are generated within the gemstone to produce visually perceptible effects such as fire and scintillation of the gemstone. By using white light sources effectively interspersed within light absorbing material, embodiments of the invention are able to provide many of the advantages of commonly-used point light sources, such as halogen spots or white-light LEDs, while substantially reducing disadvantages thereof, such as high power consumption, heat generation and/or poor colour rendering. In particular, the light sources preferably provide relatively small, bright, regions within a light absorbing background, in order to prevent the "flooding out" of visually perceptible effects within the gemstone by adjacent sources.

In another aspect, the present invention provides a method of viewing a display item within a display area, including the steps of:

positioning the item within the display area;

illuminating the display area using a lighting apparatus; and moving the item within the display region in order to produce visually perceptible effects, wherein the lighting apparatus includes a plurality of substantially white light sources arranged such that each light source is spaced apart from adjacent light sources of the apparatus, and wherein the apparatus further includes light absorbing material disposed so as to substantially occupy the spaces between adjacent sources when viewed from within the display area, whereby light is emitted into the display area as a plurality of bright regions interspersed within one or more regions of darkness.

In one preferred embodiment, the light sources are elongate linear sources arranged such that each light source is spaced apart from, and runs parallel to, adjacent light sources of the apparatus, whereby light is emitted into the display area in bright bands alternating with adjacent dark regions, wherein the elongate linear sources are arranged to extend substantially from left to right across the display area. Advantageously, with elongate linear light sources arranged in this manner, visually perceptible effects, such as fire and scintillation, may be most effectively produced by moving or rocking the item back and forth within the display area.

In yet another aspect, the present invention provides the use of a lighting apparatus within a jewelry store or showroom for illuminating an item of jewelry including at least one gemstone for the purpose of producing visually perceptible effects within the gemstone, the lighting apparatus including a plurality of substantially white light sources arranged such that each light source is spaced apart from adjacent light sources of the apparatus, wherein the apparatus further includes light absorbing material disposed so as to substantially occupy the spaces between adjacent sources when viewed from within the display area, whereby light is emitted into the display area as a plurality or bright regions interspersed within one or more regions of darkness.

The gemstone included within the item of jewelry may be a diamond, and the visually perceptible effects to be observed through the uses of the lighting apparatus may include fire and scintillation of the gemstone.

Preferably, the lighting apparatus is configured to illuminate a display area of a limited extent within a larger room, such as a jewelry store or showroom, wherein at least surrounding surfaces within the room are substantially pale in colour so as to provide diffuse reflection of incident light. It has been found by the present inventor that by placing a lighting apparatus in accordance with the invention within a diffuse reflective environment, the appearance of visually perceptible affects in a gemstone viewed within the display area may be enhanced.

For example, the lighting apparatus may be installed within a ceiling of a jewelry store or showroom, wherein surrounding areas of the ceiling are painted with a pale colour such as, for example, white, off white, cream, beige, and so forth. Alternatively, the lighting apparatus may be provided in a portable form for countertop use, within a jewelry store, showroom or other area, which is preferably decorated in a predominately pale colour.

Preferably the lighting apparatus is disposed directly above the display area. According to particularly preferred arrangements, the angle subtended by the lighting apparatus at the location of the item is between about 20° and about 45°, and more preferably is about 30°.

In some embodiments of the lighting apparatus, the light sources are configured to each emit a strip or ribbon of light, wherein the light absorbing material is disposed to occupy the spaces therebetween, whereby light is emitted into the display area in bright bands alternating with adjacent dark regions.

According to one preferred embodiment, the light sources are elongate linear sources arranged such that each light source is spaced apart from, and runs parallel to, adjacent light sources of the apparatus, whereby light is emitted into the display area in bright lines alternating with adjacent to dark regions.

In an alternative embodiment, the light sources are configured in the form of circular arcs of differing radius of curvature, disposed in a substantially concentric arrangement whereby light is emitted into the display area in bright arcs alternating with adjacent dark regions.

It will be appreciated that various alternative arrangements of bright regions interspersed within one or more regions of darkness may be provided in accordance with the invention.

In one preferred embodiment of the lighting apparatus, the substantially white light sources are fluorescent lamps. A wide range of fluorescent lamps are suitable for use in embodiments of the invention, such as warm white lamps, emitting light having a colour temperature less than 3,300 kelvin, cool white lamps, emitting light having a colour temperature in the approximate range of 3,500 to 4,500 kelvin, and/or daylight or cold white lamps emitting light having a colour temperature in excess of 6,000 kelvin. Of course, it will be appreciated that many types of white light fluorescent lamps are available, and the aforementioned categories are not intended to be exhaustive.

The fluorescent lamps may be of any shape, length, diameter and power suitable to illuminate the volume of space in which jewelry is to be viewed. For example, relatively short slimline 20 watt tubes may be used, or lamps of greater length, diameter and/or power in accordance with requirements.

The use of fluorescent lamps is particularly advantageous due to their relatively high light output, low power consumption and low heat generation. It may be possible, for example, to replace as many as 30 halogen spot lamps dissipating 50 watts each within a jewelry store or showroom with 15 or fewer fluorescent tubes each dissipating only 20 watts, producing significantly more light output than the replaced halogen lamps and generating negligible quantities of heat. Embodiments of the invention therefore enable potentially significant savings in power for lighting, and a reduced need for air conditioning for cooling of a store or showroom.

The light-absorbing material between the adjacent white light sources is preferably a substantially black non-reflective material. However, any sufficiently dark coloured light-absorbing material may be used, and colours such as dark blue and purple may provide advantages in highlighting the fire in gemstones such as diamonds.

In preferred embodiments, the fluorescent tubes are installed in recesses, such as, for example, standard fluorescent tube fixtures. The light-absorbing material may include painted surfaces disposed between the recesses. The recesses may include rear reflectors, such as parabolic reflectors, to direct light emitted from the rear of the tubes into the display area, thereby increasing the overall level of illumination.

However, in an alternative and particularly simple embodiment, fluorescent tubes are mounted flush with a common surface, and a sheet of dark cardboard or similar material rested upon the upper side of the tubes to provide the dark bands alternating with the light emitted from the tubes. Since the fluorescent tubes generate very little heat, this simple arrangement may be operated safely without risk of burning the sheet of cardboard or similar material.

The lighting apparatus may further include one or more spotlights, such as halogen lamps, as point sources of light that may further enhance the illumination of articles of jewelry, for example by creating a number of additional flashes of higher intensity within a gemstone. The spotlights may be placed, for example, at corners of, or adjacent to, the arrangement of elongate white light sources, and/or at other desired locations within the light-absorbing regions.

In alternative embodiments, a plurality of substantially white light sources having adjacent light-absorbing regions may be formed by painting suitable dark areas onto a diffuser such as a lighting dome or frosted fluorescent fixture cover. Accordingly, when the painted diffuser is placed over a light source, light is emitted in a plurality of bright regions interspersed within the painted regions of darkness.

Further benefits, advantages and preferred features of the apparatus and method of the present invention will become apparent in the following description of preferred embodiments of the invention.

BRIEF DESCRIPTIONS OF THE DRAWINGS

Preferred embodiments of the invention will now be described which should not be considered to limit any of the preceding statements. Preferred embodiments are described with reference to the following figures in which like reference numerals refer to like components, and wherein.

DESCRIPTION OF PREFERRED EMBODIMENT

Figure 1A:
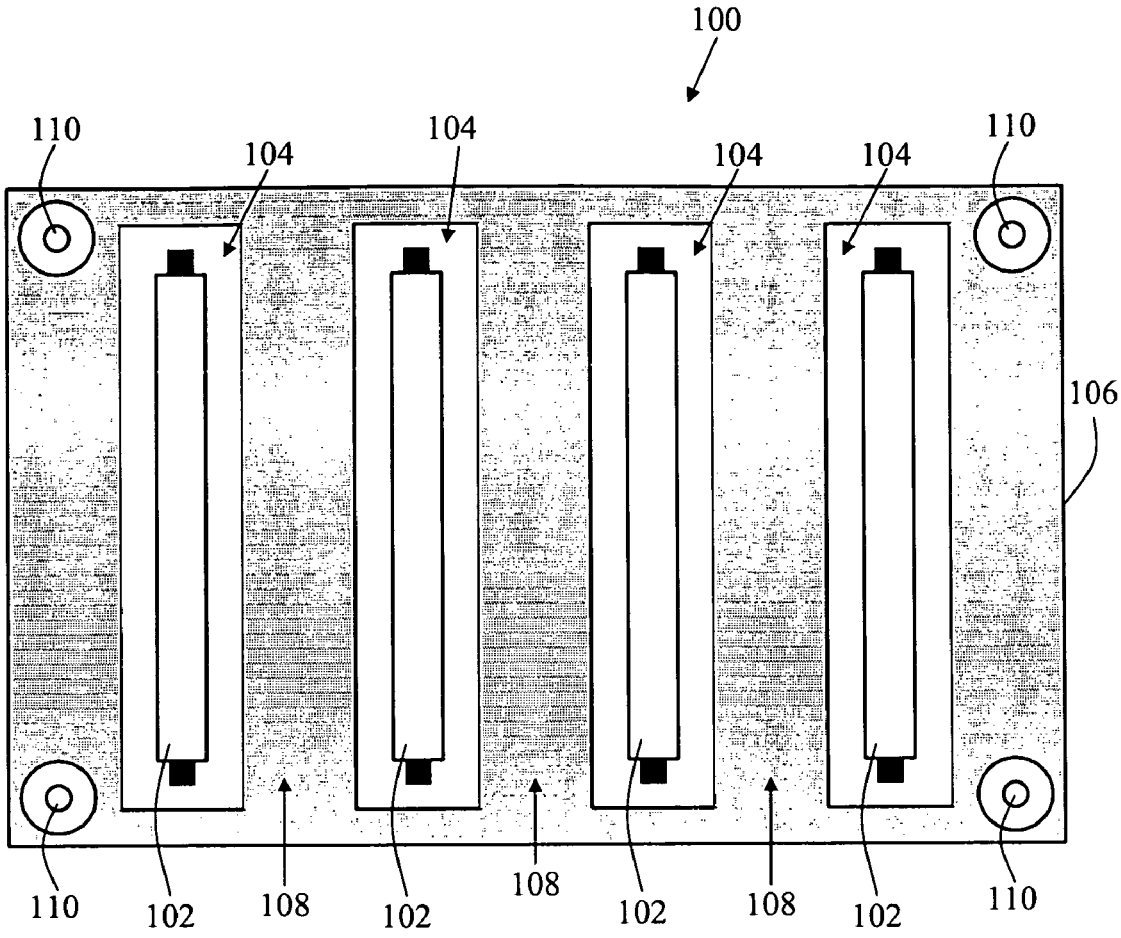
FIG. 1A illustrates a preferred embodiment of a lighting apparatus according to the invention, viewed from below.
Figure 1B:
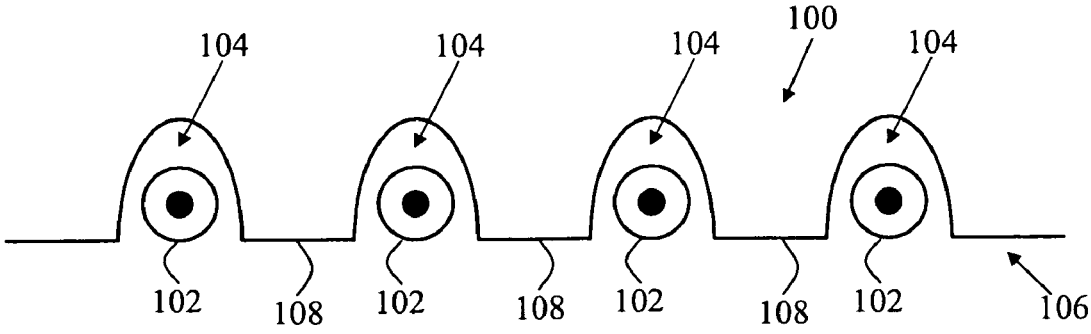
FIG. 1B depicts a side view of the lighting apparatus of FIG. 1A.

FIGS. 1A and 1B illustrate a preferred embodiment of a lighting apparatus according to the invention when viewed from below and from the side respectively. The lighting apparatus 100 includes fluorescent tubes 102 which provide a number of substantially white light sources. While four fluorescent tubes 102 are depicted in the figures, it will be appreciated that a greater or lesser number of sources may be used in embodiments of the invention, depending upon the size of a showroom, store interior, or other area to be illuminated. However, at least two sources must be provided in order to achieve the desired lighting effect produced in accordance with the invention.

It will also be appreciated that while the lighting apparatus 100 includes fluorescent tubes 102 having an elongate, linear shape, this arrangement and configuration of light sources is not limiting of the invention, which may employ light sources providing various configurations including a plurality of bright regions interspersed within one or more regions of darkness, including arrangements such as those described below with reference to FIGS. 5 and 6.

The fluorescent tubes 102 are arranged to have their longitudinal axes substantially parallel with one another. The fluorescent tubes 102 are mounted within fixtures 104, which include standard fittings (not shown in the figures) for powering the tubes 102. In the preferred embodiment 100, the fixtures 104 are recessed within panel 106, the surface of which thereby surrounds the fixtures, and in particular occupies the spaces 108 between adjacent fluorescent tubes 102 and fixtures 104 when viewed from within a display area illuminated by the apparatus. The panel 106 is manufactured from, or coated, covered or painted with a material that is light-absorbing. Preferably, the surface of the panel 106 is painted with a dark, non-reflective colour. In a particularly preferred embodiment, the surface of the panel 106 is painted black, however other dark colours, such as dark blue or purple, are also suitable, and may be advantageous in some applications of the lighting apparatus.

By the arrangement of lighting apparatus 100, when the fluorescent tubes 102 are energised, light is emitted from the apparatus in alternating bright and dark regions corresponding with the fluorescent tubes 102 in fixtures 104, and adjacent dark surface regions 108 of panel 106. In particular, the arrangement 100 of linear fluorescent tubes results in the emission of light in alternating bright and dark bands.

Figure 2A:
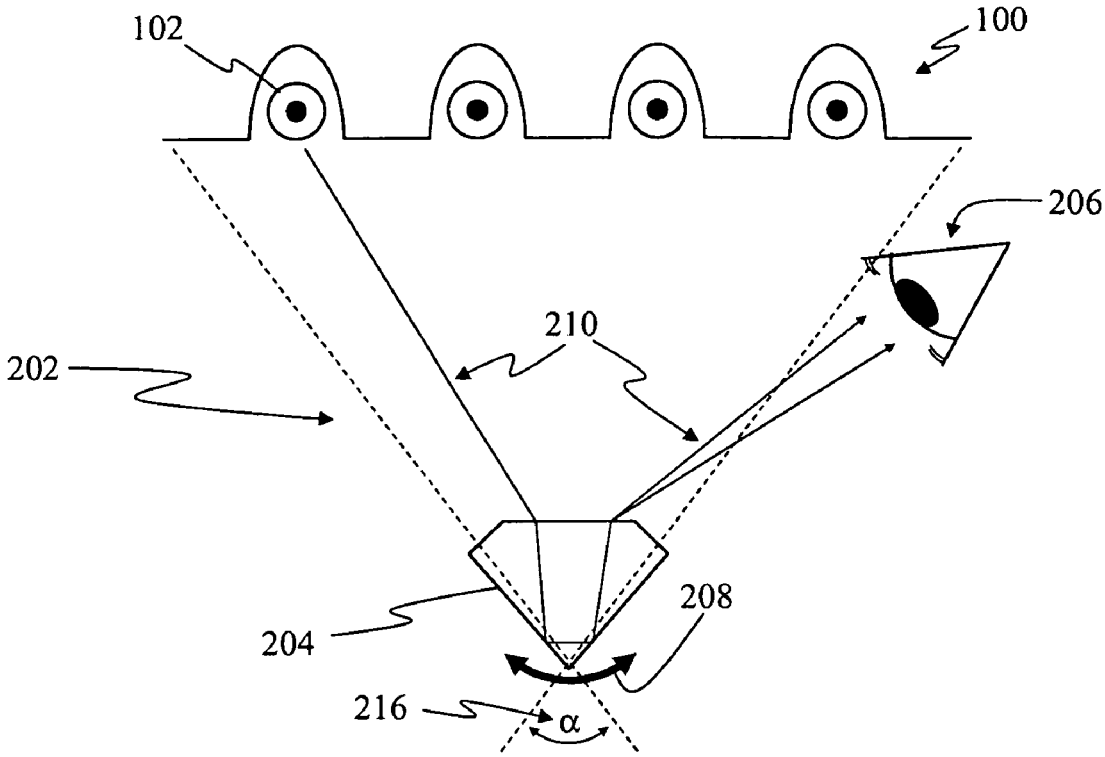
FIGS. 2A and 2B illustrate schematically the use of the lighting apparatus of FIGS. 1A and 1B for viewing a gemstone within a display area.
Figure 2B:
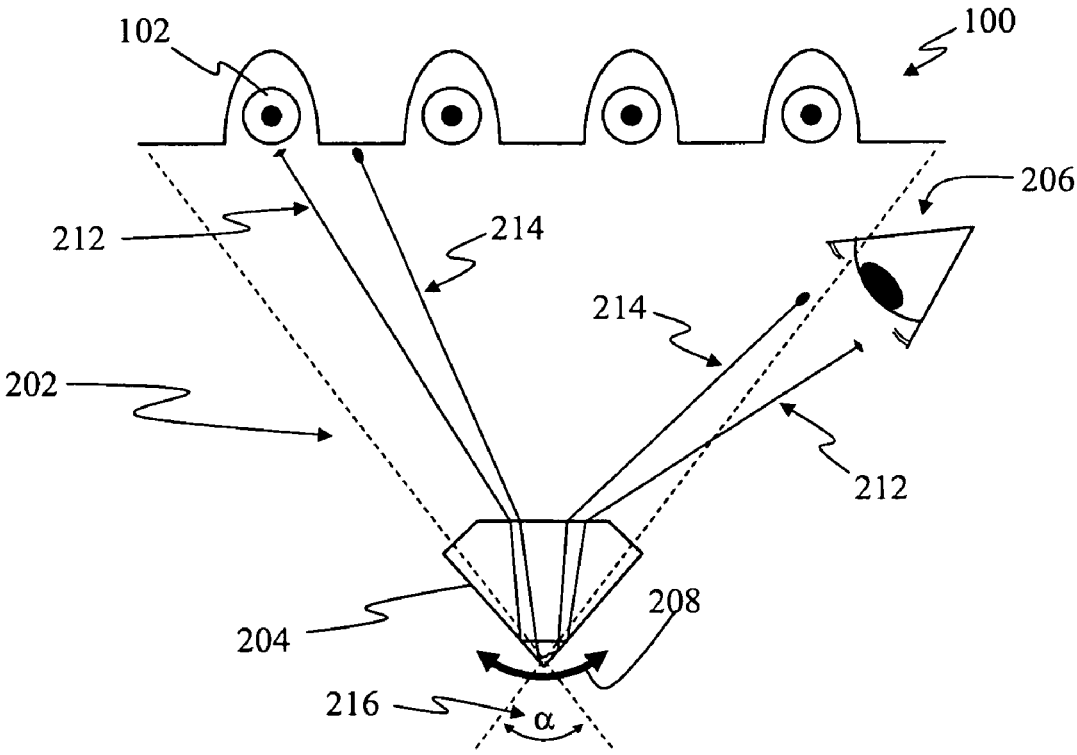

As shown schematically in FIGS. 2A and 2B, in use, the lighting apparatus 100 is installed within a jewelry store or showroom over a display area, being an area of, for example, countertop, or volume of space in which display items, such as items of jewelry are to be viewed or examined by staff and/or customers. For example, the lighting apparatus 100 may be installed in the ceiling, or suspended above a main store or showroom area. Alternatively, a smaller version of the lighting apparatus 100 may be suspended at a lower height over a desk or shop counter to illuminate a limited area within which staff and/or customers may view items of jewelry.

In normal use, the lighting apparatus 100 is used to illuminate items of jewelry that include gemstones 204 such as diamonds. The observer 206, whether staff or customer, may hold an item of jewelry to be viewed or, most commonly in the case that the item of jewelry is a ring, the observer 206 may wear the jewelry while examining it. In the course of examination, the observer 206 will move and/or rotate the item of jewelry under the lighting apparatus, for example by rolling and/or rocking it back and forth within the illuminated volume of space. In particular, if this motion is carried out in a direction (indicated by the arrow 208) running substantially perpendicular to the direction along which the longitudinal axes of the fluorescent tubes 102 are aligned, the contrast between the light and dark bands generated by the lighting apparatus 100 will result in multiple distinct reflections of the light emitted by the separate light sources within gemstones, eg 204, set in the item of jewelry. This form of illumination highlights the optical properties of the gemstones and particularly in the case of a diamond reveals the desirable and visually perceptible effects such as the fire and scintillation of the gemstone. The generation of "fire" is illustrated in FIG. 2A, wherein refraction of a light ray 210 entering and leaving facets of the gemstone 204, along with dispersion of light within the gemstone 204, produces a "rainbow" effect at the observer location 206, as the gemstone is moved 208. Scintillation may be generated as illustrated in FIG. 2B, as a result of contast between light and dark bands reflected through facets of the gemstone to the observer location 206, represented by the rays 212, 214.

It has been found to be preferable, for optimum effect, that the lighting apparatus 100 be disposed directly above the display area 202, and that the angle α (216) subtended by the lighting apparatus 100 at the location of the gemstone 204 be between about 20° and 45°, especially about 30°.

In normal use, the lighting apparatus 100 is used to illuminate items of jewelry that include gemstones such as diamonds. The observer, whether staff or customer, may hold an item of jewelry to be viewed or, most commonly in the case that the item of jewelry is a ring, the observer may wear the jewelry while examining it. In the course of examination, the observer will move and/or rotate the item of jewelry under the lighting apparatus, for example by rolling and/or rocking it back and forth within the illuminated volume of space. In particular, if this motion is carried out in a direction running substantially perpendicular to the direction along which the longitudinal axes of the fluorescent tubes 102 are aligned, the contrast between the light and dark bands generated by the lighting apparatus 100 will result in multiple distinct reflections of the light emitted by the separate light sources within gemstones set in the item of jewelry. This form of illumination highlights the optical properties of the gemstones and particularly in the case of a diamond reveals the desirable and visually perceptible effects such as the fire and scintillation of the gemstone.

A wide range of fluorescent tube types are suitable for use in the lighting apparatus 100. For example, the fluorescent tubes 102 may be warm white tubes emitting light having a colour temperature below 3,300 kelvin, cool white tubes emitting light having a colour temperature between 3,500 and 4,500 kelvin, or daylight or cold white tubes emitting light having a colour temperature in excess of 6,000 kelvin. However, any suitable white light-emitting tubes within or outside these ranges may be used.

Also, depending upon the size of the area to be illuminated and other relevant considerations, the tubes may be of any length, diameter and power that is appropriate and readily available. For example, small areas may be illuminated using relatively short, slimline 20 watt fluorescent tubes, however for larger areas, tubes of greater length, diameter and/or power may be employed.

Since fluorescent light sources produce substantially greater light output and generate less heat than incandescent or halogen bulbs having an equivalent total power dissipation, the lighting apparatus 100 may provide savings in the power required for lighting and well as for cooling the store or showroom area, when compared with available alternative lighting arrangements.

The lighting apparatus 100 may optionally also include further point light sources, such as the halogen lamps 110 located at the corners of the apparatus shown in FIG. 1. The inclusion of point light sources may further enhance the effects of fire and scintillation in gemstones viewed under the illumination of the lighting apparatus 100, thereby providing a compromise between the effectiveness of the illumination, and the overall power consumption and heat generation. Furthermore, the lamps 110 may be selected so as to provide a subjectively "warmer" light output to balance the "colder" bright white light output of the fluorescent tubes 102, especially when fluorescent lamps having a higher colour temperature are employed.

In preferred embodiments, the fixtures 104 include rear reflective surfaces, such as parabolic rear reflectors 202, to direct light emitted from the rear of fluorescent tubes 102 into the viewing region, thereby increasing the overall level of illumination provided. It will be appreciated, however, that other forms of reflector may be used, or that the inside of fixtures 104 may be coloured white to provide a diffuse reflection of light emitted from fluorescent tubes 102.

Figure 3:
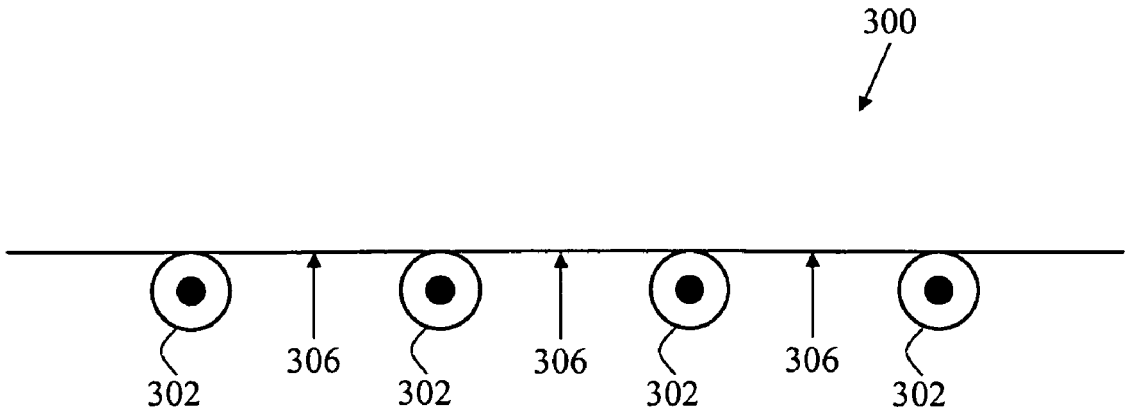
FIG. 3 depicts a side view of an alternative embodiment of a lighting apparatus according to the invention.
Figure 4:
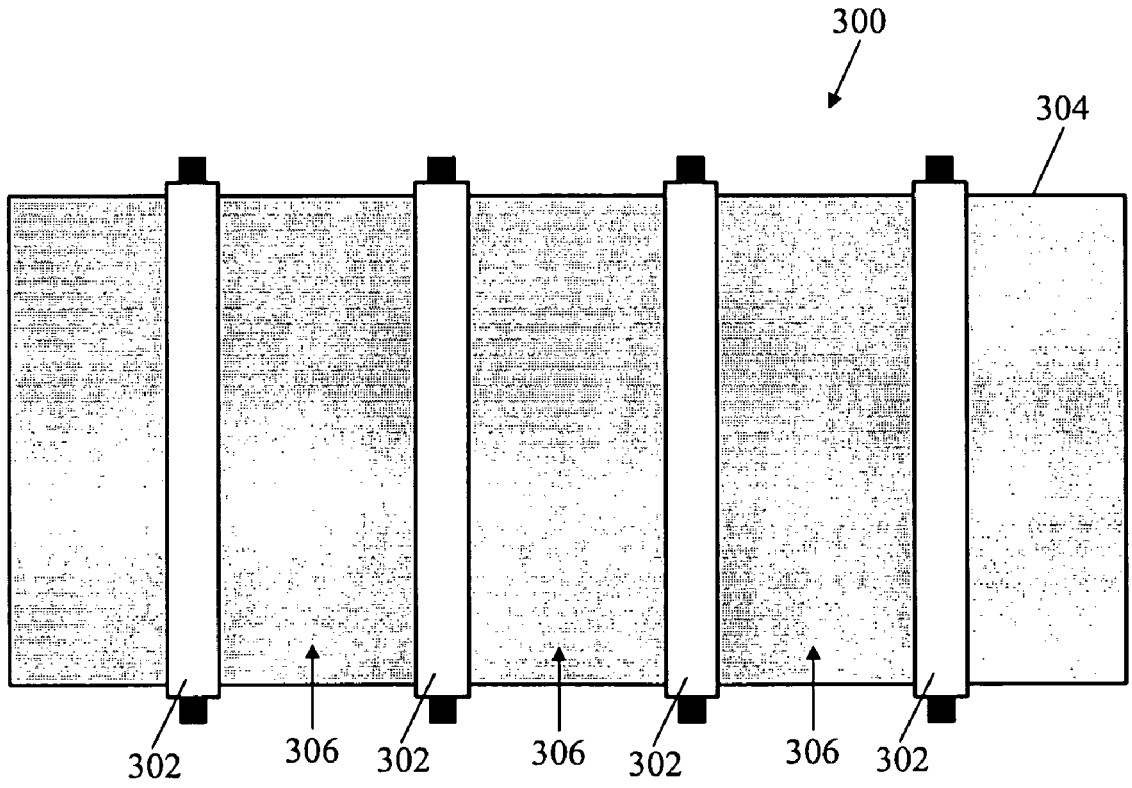
FIG. 4 illustrates the lighting apparatus of FIG. 3 viewed from below.

FIGS. 3 and 4 depict an alternative embodiment of a lighting apparatus 300 according to the invention, as viewed from the side and from below respectively. The embodiment 300 provides the particular advantages of simplicity and low cost as compared with the previously described embodiment 100. According to this embodiment, fluorescent tubes 302 are mounted in a standard fashion to a common surface such as the ceiling of a store area or showroom. A sheet of dark cardboard or similar material 304 is then inserted between the electrical connections (not shown) into which the tubes are mounted so as to rest upon the upper sides of the tubes 304. In the regions 306 between adjacent tubes 302 the sheet of cardboard or other material 304 is visible so as to provide the dark bands alternating with the light emitted from the tubes 302. Since the fluorescent tubes 302 generate very little heat, this simple arrangement may be safely operated without risk of burning the cardboard sheet 304. If it is desired to provide a more aesthetically pleasing overall effect, the completed lighting arrangement 300 may be surrounded by a frame or similar structure arranged to conceal the electrical connections of the fluorescent tubes 302, and the edges of cardboard sheet 304.

Figure 5:
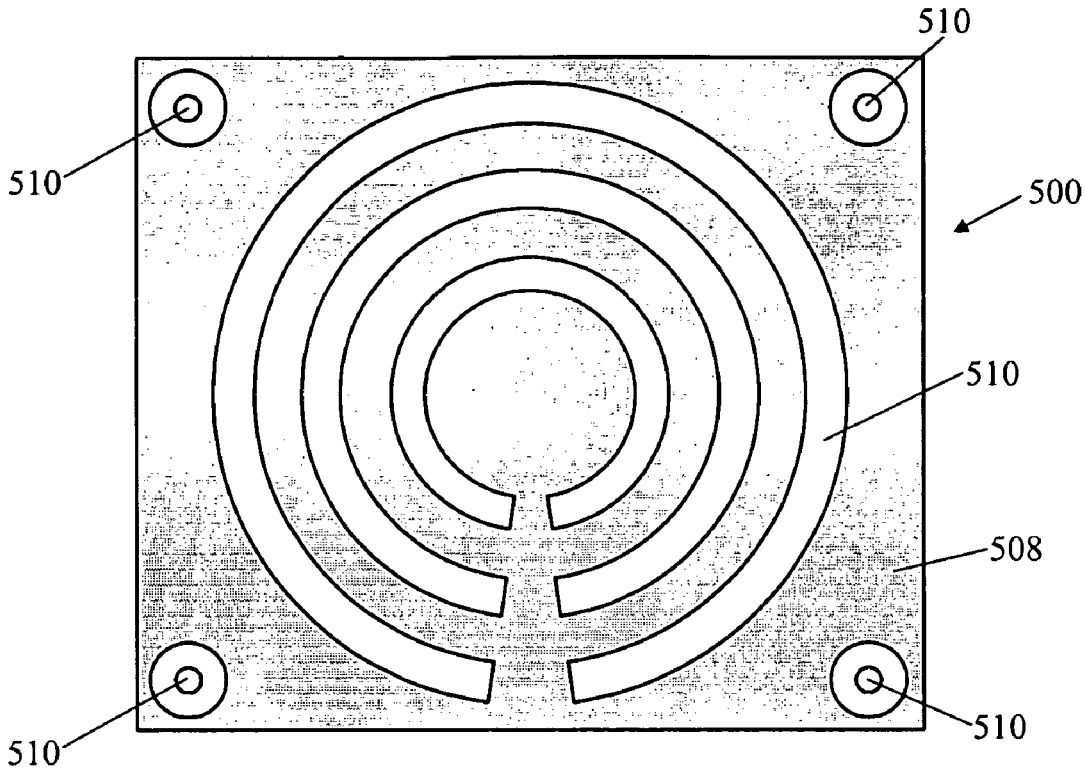
FIG. 5 illustrates a further alternative embodiment of a lighting apparatus according to the invention.

FIG. 5 illustrates a further alternative embodiment of a lighting apparatus 500 according to the present invention. The alternative embodiment of the lighting apparatus 500 employs fluorescent tubes, eg 502, formed in circular arcs, in place of the linear tubes 102, 302 employed within the embodiments 100, 300 of the invention described previously with reference to FIGS. 1 to 4.

In like fashion to lighting apparatus 100, 300, the alternative embodiment 500 shown in FIG. 5 includes a surface 508 disposed between the concentrically arranged fluorescent tubes 502, the surface 508 being coated, covered or painted with a light absorbing material. As in the embodiments of the invention previously described with reference to FIGS. 1 to 4, the surface 508 may be, for example, the surface of a recessed panel or the surface of a suitable sheet of material placed behind the fluorescent tubes 502.

As will be appreciated, the alternative arrangement 500 again provides for the emission of light into a display area in bright bands alternating with adjacent dark regions, wherein the bright bands are concentric bright arcs alternating with the adjacent regions of darkness. Accordingly, the lighting apparatus 500 provides many of the advantages of the embodiments 100, 300 previously described with reference to FIGS. 1 to 4, however, there is no longer a preferred axis for movement or rotation of an item of jewelry under the lighting apparatus, due to the substantially circular symmetry of the lighting arrangement 500. Accordingly, the arrangement 500 may be preferred for use, for example, on a desk or countertop where there may be no preferred direction of viewing of jewelry items within the display area.

Again, shown in FIG. 5 are optionally additional point light sources, such as halogen lamps 510, located at the corners of the apparatus 500.

Figure 6:
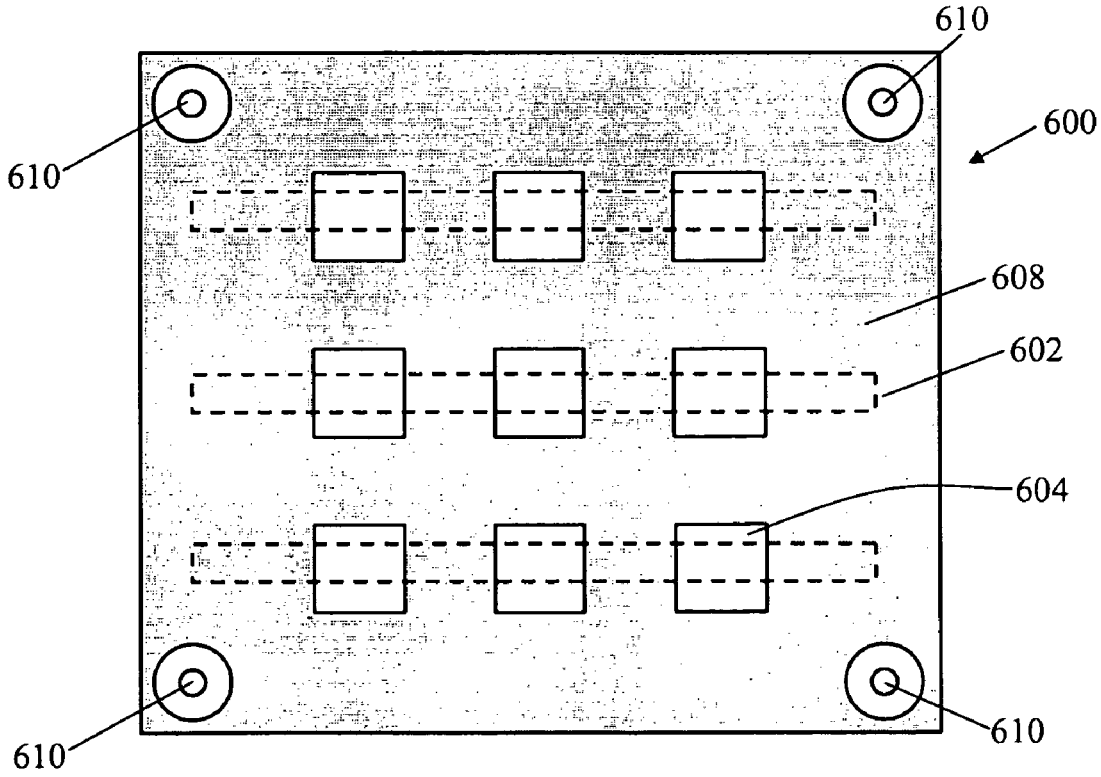
FIG. 6 illustrates yet another alternative embodiment of a lighting apparatus according to the invention.

FIG. 6 illustrates yet another alternative embodiment 600 of a lighting apparatus in accordance with the present invention. The arrangement 600 includes a panel 608 which, once again, is manufactured from, coated, covered, or painted with a material that is light absorbing. Included within the panel 608 are transparent or translucent regions 604. The transparent or translucent regions 604 may be, for example, suitably shaped holes cut into the panel 608. Alternatively, the regions 604 may include transparent or translucent glass or plastic, such as clear or frosted glass or plastic. In yet another practical arrangement, the entire panel 608 may be made from a transparent or translucent material, which is coated, covered, or painted with light absorbing material over its surface, excluding the regions 604.

In the arrangement 600 shown in FIG. 6, each of the transparent or translucent regions 604 is a substantially square region, however it will be appreciated that transparent or translucent regions may be provided having any desired shape, including the linear and circular shapes formed in the alternative arrangements previously described with reference to FIGS. 1 to 5.

The lighting apparatus 600 includes lamps disposed behind the panel 608, such as a standard linear fluorescent tubes represented by the dashed rectangles 602 in FIG. 6. By illuminating the regions 604 in this manner, when viewed from below each region appears as a light source within the surrounding dark region of panel 608.

Additionally, in some embodiments (not shown in the drawings) reflectors may be disposed around the lamps 602 and/or the transparent regions 604 in order to concentrate the light output of the lamps into the regions 604.

It will thus be understood that arrangements exemplified by the embodiment 600 may be used to form lighting apparatus in accordance with the invention, whereby in use each transparent or translucent region 604 provides a distinct substantially white light source which is spaced apart from adjacent light sources of the apparatus 600 by the light absorbing material of panel 608, whereby light is emitted into the display area as a plurality of bright regions corresponding with the regions 604, interspersed within one or more regions of darkness corresponding with the light absorbing areas of a panel 608.

Once again, optional additional point light sources 610 are located at the corners of the apparatus 600 in order to further enhance the effects of fire and scintillation in gemstones viewed under the illumination of the apparatus 600, while maintaining a reasonable overall power consumption and a level of heat generation.

CONCLUSION

A lighting apparatus embodying the present invention may be employed to illuminate a display area in which display items, such as items of jewelry, are to be viewed. Such a lighting apparatus provides bright regions of light, alternating with dark, light-absorbing regions, to enable visually perceptible properties of gemstones, such as diamonds, to be viewed. The apparatus may be constructed using light sources, such as fluorescent tubes, which are able to generate a high light output having good colour rendering properties, with relatively low power consumption and heat generation as compared with conventional point light sources such as halogen lamps.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Rather, the scope of the invention is defined by the terms of the claims appended hereto.

The invention claimed is:

1. A method of viewing visually perceptible optical effects within a gemstone positioned within a display area, the method including the steps of:

providing a lighting apparatus which includes a plurality of substantially white light sources comprising elongate linear sources arranged such that each light source is spaced apart from, and runs parallel to, adjacent light sources of the apparatus, and wherein the apparatus further includes light absorbing material disposed so as to substantially occupy the spaces between adjacent sources when viewed from within the display area, whereby light is emitted into the display area in bright lines alternating with adjacent dark regions;

illuminating the display area from above using the lighting apparatus;

positioning the gemstone within the display area; and moving the gemstone, relative to an observer, within the display area in order to produce visually perceptible effects in the gemstone which result from multiple reflections of contrasting light and dark bands generated by the lighting apparatus, wherein said visually perceptible effects include fire and scintillation of the gemstone.

2. The method of claim 1 wherein the elongate linear light sources are arranged to extend substantially from left to right across the display area relative to a viewing location.

3. The method of claim 2 wherein the step of moving the item within the display area in order to produce visually perceptible effects includes moving or rocking the item back and forth within the display area, in a direction substantially perpendicular to the direction of alignment of the elongate linear light sources.

4. The method of claim 1 including arranging the lighting apparatus to illuminate a display area of limited extent within a larger room, wherein at least surrounding surfaces within the room are substantially pale in colour so as to provide diffuse reflection of incident light.

5. The method of claim 4 including installing the lighting apparatus within a ceiling of a room, wherein surrounding areas of the ceiling are painted with a pale colour.

6. The method of claim 1 including disposing the lighting apparatus directly above the display area.

7. The method of claim 1 including arranging the lighting apparatus such that the angle subtended by the apparatus at the location of the item is between about 20° and about 45°.

8. The method of claim 1 wherein the angle subtended by the lighting apparatus at the location of the item is about 30°.

9. A method of viewing visually perceptible optical effects within a gemstone positioned within a display area, the method including the steps of:

providing a lighting apparatus which includes a plurality of elongate substantially white light sources configured in the form of circular arcs of differing radius of curvature, disposed in a substantially concentric arrangement wherein each light source is spaced apart from adjacent light sources of the apparatus, and wherein the apparatus further includes light absorbing material disposed so as to substantially occupy the spaces between adjacent sources when viewed from within the display area, whereby light is emitted into the display area in bright arcs alternating with adjacent dark regions;

illuminating the display area from above using the lighting apparatus;

positioning the gemstone within the display area; and moving the gemstone, relative to an observer, within the display area in order to produce visually perceptible effects in the gemstone which result from multiple reflections of contrasting light and dark bands generated by the lighting apparatus, wherein said visually perceptible effects include fire and scintillation of the gemstone.

10. The method of claim 9 wherein the step of moving the item within the display area in order to produce visually perceptible effects includes moving or rocking the item back and forth within the display area, in a direction substantially perpendicular to the direction of alignment of the elongate linear light sources.

11. The method of claim 9 including arranging the lighting apparatus to illuminate a display area of limited extent within a larger room, wherein at least surrounding surfaces within the room are substantially pale in colour so as to provide diffuse reflection of incident light.

12. The method of claim 11 including installing the lighting apparatus within a ceiling of a room, wherein surrounding areas of the ceiling are painted with a pale colour.

13. The method of claim 9 including disposing the lighting apparatus directly above the display area.

14. The method of claim 9 including arranging the lighting apparatus such that the angle subtended by the apparatus at the location of the item is between about 20° and about 45°.

15. The method of claim 9 wherein the angle subtended by the lighting apparatus at the location of the item is about 30°.

* * * * *